US005753178A

United States Patent [19]

Davidson et al.

[11] Patent Number: 5,753,178

[45] Date of Patent: May 19, 1998

[54] AUSTENITIC STAINLESS STEEL FOR USE WHEN HOT

[75] Inventors: James Henry Davidson, Varennes-Vauzelles; Williams Mihoub, Nevers, both of France

[73] Assignee: IMPHY S.A., Puteaux, France

[21] Appl. No.: 687,423

[22] PCT Filed: Dec. 7, 1995

[86] PCT No.: PCT/FR95/01617

§ 371 Date: Aug. 8, 1996

§ 102(e) Date: Aug. 8, 1996

[87] PCT Pub. No.: WO96/18750

PCT Pub. Date: Jun. 20, 1996

[30] Foreign Application Priority Data

Dec. 13, 1994 [FR] France ..... 94 14942

[51] Int. Cl.[6] ..... C22C 38/50

[52] U.S. Cl. ..... 420/53; 420/54

[58] Field of Search ..... 420/53, 54

[56] References Cited

U.S. PATENT DOCUMENTS 2,744,821 5/1956 Osman ..... 420/53

3,065,068 11/1962 Dyrkacz et al. ..... 420/53

FOREIGN PATENT DOCUMENTS 60-29453 2/1985 Japan ..... 420/53

*Primary Examiner*—Deborah Yee

*Attorney, Agent, or Firm*—Oblon, Spivak, McClelland, Maier & Neustadt, P.C.

[57] ABSTRACT

Austenitic stainless steel for use when hot, the chemical composition of which, by weight, includes from 16% to 25% of Ni, from 16% to 18.5% of Cr, from 0% to 3% of Mo, from 0% to 2% of Mn, from 1% to 3.5% of Ti, from 0% to 1.5% of Al, less than 0.1% of C+N, up to 0.025% of B, the remainder being iron and impurities resulting from the production; the chemical composition additionally satisfying the relations:

$(0.94\times Ni-65\times F)/(1-F)\geqq 12$ and $17\leqq(1.07\times Cr-1.5\times F)/(1-F)\leqq 22$ with:

$F=0.0444\times Ti+0.0777\times Al-0.0592$.

14 Claims, No Drawings

AUSTENITIC STAINLESS STEEL FOR USE WHEN HOT

BACKGROUND OF THE INVENTION

1. Field of the Invention

The invention relates to an austenitic stainless steel for use when hot.

2. Discussion of the Background

Many items of equipment such as, for example, aircraft engines, motor vehicle engines, steam turbines or steam generators include components which must withstand high temperatures. These components are, for example but not exclusively, bolts or couplings. They must be capable of working at temperatures that can reach 750° C.

To manufacture these components, either alloys of the 286 type or martensitic stainless steels are employed.

Alloy 286 is an austenitic superalloy containing approximately 26% of nickel, 15% of chromium, 1.25% of molybdenum and 2% of titanium. The titanium is intended to form hardening precipitates of $\gamma'$ phase. These alloys can be employed up to 700° C. but not beyond this because, above this temperature, the $\gamma'$ phase is unstable and tends to be transformed into the $\eta$ phase, which is less hardening. Moreover, since the nickel content is high, these alloys are expensive.

Martensitic stainless steels contain approximately 12% of chromium and little or no nickel, with the result that their price is substantially lower than that of the alloys of the 286 type but, on the other hand, they can be employed only up to 600° C., and this is insufficient for some applications.

The aim of the present invention is to overcome these disadvantages by proposing a stainless steel for use when hot, which is more economical than the alloys of the 286 type and which has mechanical characteristics when hot that are comparable or even superior to those of these alloys.

SUMMARY OF THE INVENTION

To this end, the subject-matter of the invention is an austenitic stainless steel for use when hot, the chemical composition of which, by weight, includes:

$16\% \leqq Ni \leqq 25\%$ $16\% \leqq Cr \leqq 18.5\%$ $0\% \leqq Mo \leqq 3\%$ $0\% \leqq Mn \leqq 2\%$ $1\% \leqq Ti \leqq 3.5\%$ $0\% \leqq Al \leqq 1.5\%$ $C+N \leqq 0.1\%$ $0\% \leqq B \leqq 0.025\%$ the remainder being iron and impurities resulting from the production; the chemical composition additionally satisfying the relations:

$(0.94 \times Ni - 65 \times F)/(1-F) \geqq 12$ and $17 \leqq (1.07 \times Cr - 1.5 \times F)/(1-F) \leqq 22$ with:

$F = 0.0444 \times Ti + 0.0777 \times Al - 0.0592$

The chemical composition, by weight, is preferably such that:

$0.45\% \leqq Al \leqq 1.2\%$ and $(1.2 \times Ti - 0.6)/(2.1 \times Al - 0.9) \geqq 1.5$ It is also preferable that the boron content should be between 0.005% and 0.020%.

The invention also relates to the use of a steel according to the invention for the manufacture of bolts for use when hot, which are intended especially to be fitted to motor vehicle engines.

The invention will now be described more precisely but without any limitation being implied.

DETAILED DESCRIPTION OF THE PREFERRED EMBODIMENTS

The steel according to the invention is a stainless steel consisting of a stable $\gamma$ austenitic matrix hardened by $\gamma'$ phase precipitates $Ni_3Ti$ or, better, $Ni_3(Ti,Al)$ of cubic structure, containing enough aluminium to limit the transformation of the $\gamma'$ phase into $\eta$ phase of the same composition but of hexagonal structure, and not containing too much aluminium in order not to form the $Ni_2AlTi$ phase.

In order to be capable of forming sufficient hardening precipitates, the steel must contain more than 1% of titanium, but the content of this element must remain lower than 3.5% and preferably lower than 3%, because beyond this it impairs the plastic deformability when hot, and this makes forming operations by rolling or by forging difficult. Moreover, when the titanium content is too high the steel must be remelted under vacuum in order to limit segregations, and this operation is very costly.

The aluminium content must not exceed 1.5% and preferably 1.2%, on the one hand in order to limit the segregations and the difficulties in forming by plastic deformation when hot and, on the other hand, in order to avoid the formation of an $Ni_2AlTi$ phase. To ensure the stability of the $\gamma'$ phase, the aluminium content must preferably be between 0.45% and 1.2%.

For the hardening effect of the precipitates to be optimal, it is preferable that the titanium and aluminium contents should be such that:

$(1.2 \times Ti - 0.6)/(2.1 \times Al - 0.9) \geqq 1.5$

The nickel content must be between 16% and 25% and must preferably be lower than 23%, and the chromium content must be between 16% and 18.5% and must preferably be lower than 18% in order that, after formation of the precipitates, the matrix should remain austenitic and in order to limit the formation of ferrite which lowers the strength when hot, or of $\sigma$ phase or of $\chi$ phase, which embrittle the steel. Moreover, beyond 25%, nickel, which is a very costly element, has no significant effect on the properties of the steel according to the invention, bearing in mind the upper limits of the titanium and aluminium contents.

In order that, after formation of the precipitates, the austenitic matrix should have an optimum composition, it is preferable that:

$(0.94 \times Ni - 65 \times F)/(1-F) \geqq 12$ and that:

$17 \leqq (1.07 \times Cr - 1.5 \times F)/(1-F) \leqq 22$, and, better, $\leqq 20$.

In these two formulae Ni is the nickel content of the steel, Cr is the chromium content, and F is calculated from the formula:

$F = 0.0444 \times Ti + 0.0777 \times Al - 0.0592$ in which Ti is the titanium content of the steel and Al is the aluminium content.

The steel may also contain:

between 0% and 3% of molybdenum, to harden the austenitic matrix by solid solution; however, its content must not be too high because this element segregates strongly and promotes the formation of $\sigma$ phase, between 0% and 2% of manganese, because this element is gammagenic and can replace part of the nickel; however, in too large a quantity it impairs the hot oxidation resistance of the steel, less than 0.1% of carbon plus nitrogen and preferably less than 0.05%, to avoid forming too much of titanium carbides or titanium or aluminium nitrides, between 0% and 0.025% of boron, and preferably between 0.005% and 0.02% and, better still, less than 0.015%, to reinforce the grain boundaries and to improve the ductility when hot.

When the steel is produced by remelting scrap alloys or steel, it may additionally contain residual elements such as silicon, copper, cobalt or vanadium, in contents of less than 0.5% in the case of each of these elements.

The remainder of the chemical composition consists of iron and of impurities resulting from the production.

This steel may be manufactured in any desired form: sheet, rod, section, wire or forged piece.

In order to be given its use properties, it may be subjected to a heat treatment consisting, for example, of dissolving by heating between 850° C. and 1050° C. for approximately an hour, followed by rapid cooling to avoid an uncontrolled precipitation, for example by quenching with water, and then by annealing by a hold of 10 to 24 hours at a temperature of between 680° C. and 760° C., followed by quenching with air. An elasticity limit at ambient temperature of between 500 MPa and 900 MPa and a tensile strength of between 850 MPa and 1200 MPa are thus obtained and, in the case of a standard creep test at 650° C. under a stress of 480 MPa, the failure period is longer than the limit of 23 hours specified for the alloy of the 286 type for aeronautic applications, the composition of which includes approximately 26% of nickel, 15% of chromium, 1.25% of molybdenum, 2% of titanium, 0.3% of vanadium, less than 0.35% of aluminium, 1.5% of manganese, 0.7% of silicon and less than 0.08% of carbon. It should be noted that this alloy, containing 26% of nickel, is much more costly than the steel according to the invention. It is possible to obtain a creep resistance equivalent to that of the 286 grade with less nickel, which is a costly element, or else a higher strength when the nickel content approaches that of the 286 grade.

Steels A to G were manufactured by way of example, the chemical compositions of which, in % by weight, are given in the following table:

| Alloy | Fe | Ni | Cr | Mn | Si | Mo | Ti | Al | C | B |
|---|---|---|---|---|---|---|---|---|---|---|
| A | bal | 16.87 | 16.99 | 1.01 | 0.011 | 1.27 | 2.34 | 0.13 | 0.032 | 0.0063 |
| B | bal | 17.98 | 16.41 | 0.96 | 0.011 | 1.27 | 2.40 | 0.58 | 0.028 | — |
| C | bal | 18.16 | 16.49 | 0.99 | 0.018 | 1.26 | 2.45 | 0.58 | 0.030 | 0.0075 |
| D | bal | 17.92 | 16.73 | 0.99 | <0.01 | 1.25 | 2.40 | 0.62 | 0.021 | 0.014 |
| E | bal | 17.84 | 16.74 | 0.96 | <0.01 | 1.24 | 2.34 | 0.62 | 0.014 | 0.016 |
| F | bal | 17.89 | 18.39 | 1.03 | <0.01 | 1.24 | 2.30 | 0.63 | 0.022 | 0.0094 |
| G | bal | 23.12 | 16.03 | 1.01 | <0.01 | 1.25 | 3.00 | 1.00 | 0.020 | 0.0096 |

Wires and then bolts were manufactured with steel A, and were subjected to two separate heat treatments which enabled the following mechanical characteristics to be obtained:

first heat treatment:

dissolving 1 hour at 980° C.—quenching with water; annealing 16 hours at 720° C.—quenching with air mechanical characteristics obtained:

| Temperature | Re (MPa) | Rm (MPa) |
|---|---|---|
| 20° C. | 670 | 990 |
| 600° C. | 626 | 815 |
| 750° C. | 512 | 540 |

Creep at 650° C. under 480 MPa: time to failure:

91.5 h, elongation at break: 22.7% second heat treatment:

dissolving 1 hour at 900° C.—quenching with water; annealing 16 hours at 720° C.—quenching with air characteristics obtained:

at ambient temperature: Re=550 MPa, Rm=860 MPa

Creep at 650° C. under 480 MPa: time to failure:

197.0 h; elongation at break: 25.8%.

In the case of alloys B to G the creep results at 650° C. under 480 MPa on test pieces which had undergone a heat treatment consisting of a hold for one hour at 1000° C. followed by quenching with water, followed by a hold of 16 hours at 720° C. followed by cooling with air, were the following:

| Alloy | $t_F$ (hours) | $A_R$ (%) | $\Sigma_R$ (%) |
|---|---|---|---|
| B | 23.5 | 17.3 | 32.7 |
| | 26.5 | 16.0 | 32.3 |
| | 26.0 | 17.5 | 34.8 |
| | 25.7 | 19.5 | 37.4 |
| C | 52.1 | 25.2 | 46.9 |
| | 53.9 | 30.9 | 48.5 |
| | 73.9 | 25.7 | 59.0 |
| | 77.9 | 25.9 | 57.2 |
| D | 77.9 | 21.9 | 47.4 |
| | 88.5 | 21.8 | 44.1 |
| | 71.4 | 20.5 | 44.5 |
| | 81.8 | 21.3 | 43.8 |
| E | 99.4 | 22.2 | |
| | 97.5 | 24.5 | |
| | 100.7 | 27.5 | 44.5 |
| | 93.7 | 31.5 | 49.0 |
| F | 71.7 | 22.5 | 38.0 |
| | 73.8 | 22.5 | 40.5 |
| | 104.8 | 22.5 | 41.5 |
| | 97.6 | 23.5 | 40.0 |

-continued

| Alloy | $t_F$ (hours) | $A_R$ (%) | $\Sigma_R$ (%) |
|---|---|---|---|
| G | 224.0 | 10.3 | 16.1 |
| | 195.0 | 7.2 | 8.2 |
| | 213.7 | 25.1 | 26.0 |
| | 224.0 | 8.4 | 9.1 |

$t_F$ is the time to failure,
$A_R$ is the elongation at break,
$\Sigma_R$ is the striction.

The properties of the steel according to the invention make it particularly suitable for the manufacture of connecting components and especially of bolts for use when hot, in particular for assembling components of a heat engine and, for example, for securing a turbo compressor to the exhaust manifold of a motor vehicle engine.

The steel according to the invention is also highly suited for the manufacture of components for boilers or for steam turbines of thermal power stations, such as pipes, exchangers or rotors.

We claim:

1. Austenitic stainless steel whose chemical composition, by weight, comprises:

$16\% \leqq Ni \leqq 25\%$ $16\% \leqq Cr \leqq 18.5\%$ $0\% \leqq Mo \leqq 3\%$ $0\% \leqq Mn \leqq 2\%$ $1\% \leqq Ti \leqq 3.5\%$ $0\% \leqq Al \leqq 1.5\%$ $C+N \leqq 0.1\%$ $0\% \leqq B \leqq 0.025\%$ the remainder being iron and impurities resulting from the production; the chemical composition additionally satisfying the relations:

$(0.94 \times Ni - 65 \times F)/(1-F) \geqq 12$ and $17 \leqq (1.07 \times Cr - 1.5 \times F)/(1-F) \leqq 22$ with:

$F = 0.0444 \times Ti + 0.0777 \times Al - 0.0592.$

2. Austenitic stainless steel according to claim 1, whose chemical composition, by weight, comprises:

$16\% \leqq Ni \leqq 23\%$ $16\% \leqq Cr \leqq 18\%$ $0\% \leqq Mo \leqq 3\%$ $0\% \leqq Mn \leqq 2\%$ $1\% \leqq Ti \leqq 3\%$ $0\% \leqq Al \leqq 1.2\%$ $C+N \leqq 0.1\%$ $0\% \leqq B \leqq 0.02\%$ the remainder being iron and impurities resulting from the production; the chemical composition additionally satisfying the relations:

$(0.94 \times Ni - 65 \times F)/(1-F) \geqq 12$ and $17 \leqq (1.07 \times Cr - 1.5 \times F)/(1-F) \leqq 20$ with:

$F = 0.0444 \times Ti + 0.0777 \times Al - 0.0592.$

3. Steel according to claim 1, whose chemical composition, by weight, is such that:

$0.45\% \leqq Al \leqq 1.2\%.$

4. Steel according to claim 3, whose chemical composition, by weight, is such that:

$(1.2 \times Ti - 0.6)/(2.1 \times Al - 0.9) \geqq 1.5.$

5. Steel according to claim 1, wherein its boron content is between 0.005% and 0.020%.

6. A steel component part comprising the steel of claim 1.

7. The steel part of claim 6, in the form of a bolt.

8. The steel part of claim 6, in the form of a boiler component or a steam turbine component.

9. The steel part of claim 8, in the form of a pipe, exchanger or rotor.

10. The steel according to claim 1, whose chemical composition, by weight, consists essentially of:

$16\% \leqq Ni \leqq 25\%$ $16\% \leqq Cr \leqq 18.5\%$ $0\% \leqq Mo \leqq 3\%$ $0\% \leqq Mn \leqq 2\%$ $1\% \leqq Ti \leqq 3.5\%$ $0\% \leqq Al \leqq 1.5\%$ $C+N \leqq 0.1\%$ $0\% \leqq B \leqq 0.025\%$ the remainder being iron and impurities resulting from the production; the chemical composition additionally satisfying the relations:

$(0.94 \times Ni - 65 \times F)/(1-F) \geqq 12$ and $17 \leqq (1.07 \times Cr - 1.5 \times F)/(1-F) \leqq 22$ with:

$F = 0.0444 \times Ti + 0.0777 \times Al - 0.0592.$

11. The steel according to claim 1, whose chemical composition, by weight, consists of:

$16\% \leqq Ni \leqq 25\%$ $16\% \leqq Cr \leqq 18.5\%$ $0\% \leqq Mo \leqq 3\%$ $0\% \leqq Mn \leqq 2\%$ $1\% \leqq Ti \leqq 3.5\%$ $0\% \leqq Al \leqq 1.5\%$ $C+N \leqq 0.1\%$ $0\% \leqq B \leqq 0.025\%$ the remainder being iron and impurities resulting from the production; the chemical composition additionally satisfying the relations:

$(0.94 \times Ni - 65 \times F)/(1-F) \geqq 12$ and $17 \leqq (1.07 \times Cr - 1.5 \times F)/(1-F) \leqq 22$ with:

$F = 0.0444 \times Ti + 0.0777 \times Al - 0.0592.$

12. The steel according to claim 1, having an elasticity limit at ambient temperature of between 500 MPa and 900 MPa and a tensile strength of between 850 MPa and 1200 MPa.

13. The steel according to claim 10, having an elasticity limit at ambient temperature of between 500 MPa and 900 MPa and a tensile strength of between 850 MPa and 1200 MPa.

14. The steel according to claim 11, having an elasticity limit at ambient temperature of between 500 MPa and 900 MPa and a tensile strength of between 850 MPa and 1200 MPa.

* * * * *